United States Patent [19]

Keim

[11] 3,981,430

[45] Sept. 21, 1976

[54] CONTAINER WITH IMPROVED POUR SPOUT

[75] Inventor: Cameron D. Keim, Fremont, Mich.

[73] Assignee: Gerber Products Company, Fremont, Mich.

[22] Filed: July 9, 1975

[21] Appl. No.: 594,467

[52] U.S. Cl. ..... 229/17 R

[51] Int. Cl.[2] ..... B65D 5/72; B65D 83/00

[58] Field of Search ..... 229/17 R, 7 R

[56] References Cited

UNITED STATES PATENTS

| | | | |
|---|---|---|---|
| 2,097,647 | 11/1937 | Scott | 229/17 R |
| 2,294,964 | 9/1942 | Davidson | 229/17 R |
| 2,475,677 | 7/1949 | Ringler | 229/17 R |
| 2,509,289 | 5/1950 | Dunning | 229/17 R |
| 2,654,525 | 10/1953 | Adorney et al. | 229/17 R |
| 2,850,222 | 9/1958 | Hultin | 229/17 R |
| 3,175,749 | 3/1965 | Elias | 229/17 R |
| 3,447,752 | 6/1969 | Deckys | 229/17 R |
| 3,692,227 | 9/1972 | Hennessey | 229/17 R |

*Primary Examiner*—Davis T. Moorhead
*Attorney, Agent, or Firm*—Townsend and Townsend

[57] ABSTRACT

A container for holding a mass of a flowable solid material comprising a bottom, at least one end wall and a pair of side walls, each having a generally upright side margin therebetween to which the end wall is coupled. The end wall is provided with a pair of arcuate fold lines extending upwardly from respective side margins and being covergent relative to each other at a location near the upper extremity of the end wall intermediate the side margins. The side walls and end wall are formed of a material having sufficient flexibility to permit the sides to be moved toward each other while simultaneously allowing the end wall to flex outwardly along the fold lines so that the upper portion of the end wall forms a spout to control the pouring of the flowable solid material from the box.

9 Claims, 4 Drawing Figures

FIG _ 1
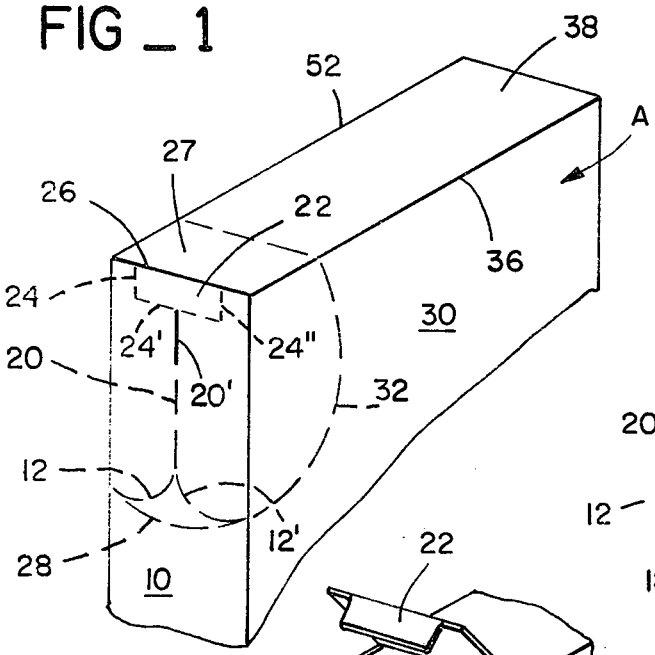
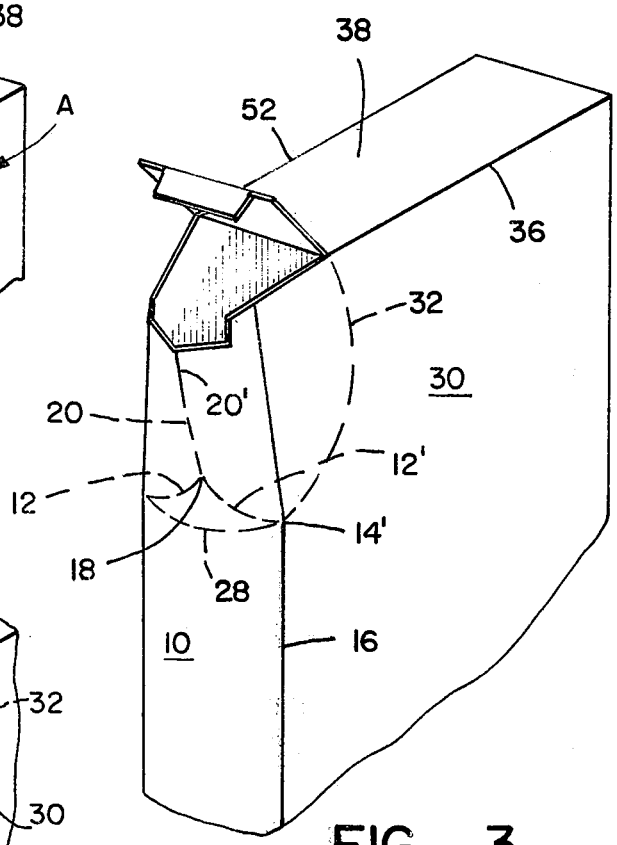
FIG _ 3
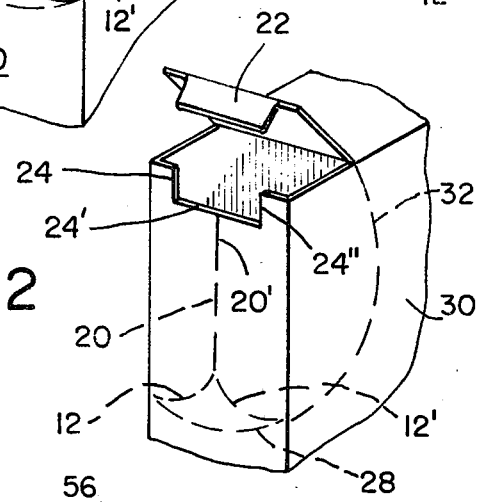
FIG _ 2
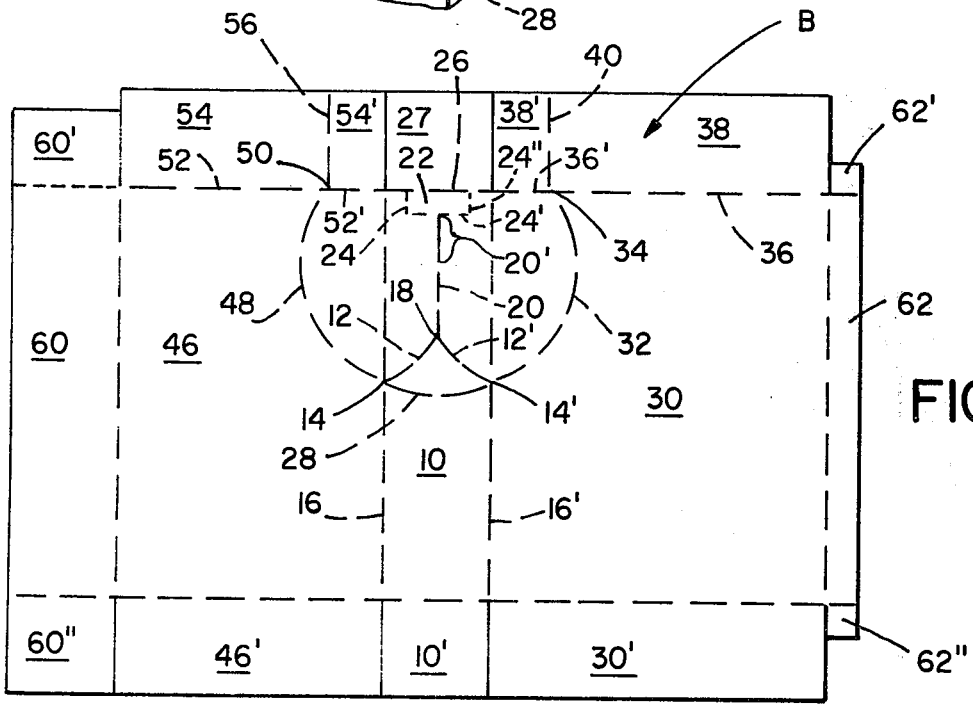
FIG _ 4

CONTAINER WITH IMPROVED POUR SPOUT

BACKGROUND OF THE INVENTION

At an early date, boxes adapted to dispense granular materials were provided with retractable metallic pour spouts. More recently, carton blanks have been developed that provide a pour spout formed from the fiberboard itself only as pressure is continually applied to the sides of the container; see for example U.S. Pat. No. 3,447,732. Still more recently, a fiberboard carton has been developed that can be distorted to provide a pour spout at an edge thereof that tends to remain either in the open or closed position; see U.S. Pat. No. 3,692,227.

SUMMARY OF THE INVENTION

The present invention relates to containers, or receptacles, for comminuted or granular free flowing substances such as cereals and the like. More particularly, the invention relates to containers of a class having a portion of the fiberboard panels thereof distortable to simultaneously provide both a discharge aperture and a V-shaped pouring spout that can be positively maintained in either a closed position or an open position.

Alternatively, the invention is directed to a carton blank including portions adapted to be interengaged in such a manner as to create a carton that will permit manipulation of a pouring spout into an open and a closed position merely by distorting the fiberboard itself.

This invention resides in the discovery that by utilizing certain arcuate fold lines in a side wall of the container, the container can be readily distorted and locked into a V-shaped pour spout configuration merely by momentarily applying sufficient pressure to deform the sides of the carton. Thereafter, the application of a corresponding amount of pressure to the tip of the V-pour spout will cause the fiberboard to return to the normal rectangular carton configuration.

Thus, the present invention provides an integrated paper pour spout distinguishable from those currently available by its ease of opening and pouring, its maintenance of the pouring configuration, its ability to be positively reclosed, and the ability to be repeatedly opened and closed. It is a principal object of this invention to provide a carton structure that can be readily deformed into a fixed spout position to improve material pouring, yet thereafter be returned to a closed configuration to prevent spilling.

The objects, features and advantages of this invention, as well as others, will be readily apparent when reference is made to the following detailed disclosure, especially in view of the attached drawing.

BRIEF DESCRIPTION OF THE DRAWINGS

FIG. 1 represents a sealed rectangular container according to the present invention;

FIG. 2 represents the container of FIG. 1 wherein the tab has been lifted to unseal the container;

FIG. 3 represents the container of FIG. 2 during dispensing subsequent to application of manual pressure; and FIG. 4 represents a blank adapted to form the container of FIGS. 1–3.

Referring now to the drawings wherein similar characters of reference represent corresponding parts in each of the several views, there is shown carton A formed from paperboard blank B. Container A includes end wall 10 having a pair of arcuate fold lines 12 and 12', extending upwardly from respective of intersections 14 and 14' with side margins 16 and 16'. Arcuate fold lines 12 and 12' intersect at their other end at a common point 18 intermediate side margin 16 and 16'. Preferably, point 18 is equidistant from side margins 16 and 16'. Common point 18 is also preferably spaced from the top of end wall 10 by a distance defined by fold line 20, extending generally parallel to side margin 16 and 16'. Still more preferably, fold line 20 comprises in part slit 20' defining a portion of its upper end as hereinafter more specifically described.

The upper portion of side wall 10 has formed therein tab 22, defined by perforated score lines 24, 24' and 24''. The remaining side of tab 22 is formed by fold line 26, defining the upper margin of end wall 10 at its attachment to top end flap 27.

Front wall 30 is provided with an arcuate fold line 32 extending from intersection 14' to intersection 34 in top margin 36 between front wall 30 and upper front flap 38. Top margin 36 comprises perforated score line 36' extending from the edge thereof to intersection 34. Similarly, back wall 46 is provided with arcuate fold lines 48 intersecting side margin 16 at intersection 14. The other end of arcuate fold line 48 intersects top margin 52 between back wall 46 and upper back flap 54 at point 50. Again, top margin 52 comprises perforated score line 52' extending from the edge thereof to intersection 50.

Flap 38 is further provided with fold line 40 extending from intersection 34 generally perpendicular to top margin 36 to form tab extension 38'. Similarly, top flap 54 is provided with a fold line 56 extending from intersection 50 generally perpendicular to top margin 52 to form tab extension 54'. Tab extensions 38' and 54' correspond in length to the height of tab 27 and are adapted to be adhesively secured to tab 27 during assembly of carton A.

To complete the configuration in the carton blank B, there is disclosed a further end wall 60 bearing top end flap 60' and bottom end flap 60''. Blank B also is provided with back wall bottom flap 46', side wall bottom flap 10' and front wall bottom flap 30'.

In a preferred embodiment, side wall 10 is further provided with arcuate fold line 28 extending between intersections 14 and 14'. Each of the arcuate foid lines 12, 12', 32, 48 and 28 is preferably defined by a segment of a circle having an identical radius of curvature.

To form the box of FIGS. 1–3 from the blank of FIG. 4, all panels are initially bent along the dashed lines. These dashed fold lines may be formed by scoring the blank during assembly. Thus, panels 10, 30, 46 and 60 are folded out of the plane of the drawing and toward each other to form a rectangular body having opposed walls 30, 46 and 10, 60. Glue flap 62 is provided with adhesive thereon and is folded inside of panel 60 to secure the rectangular body. Flap 62' is folded inwardly and flap 60' is folded inwardly thereover. Similarly, top flap 27 is folded inwardly and top flaps 38 and 54 are folded inwardly on top of flap 27 and flap 60'. As a result, fold lines 40 and 56 are generally above each other and over flap 27. Flaps 38 and 54 adhesively adhere to each other and the overlapping portions of flaps 27 and 60' to close the upper end of the container. Similarly, flaps 60'', 46', 10', 30' and 62'' are folded inwardly and adhesively overlap to close the bottom of container A.

The pouring spout of this invention comprises, in the relaxed state, normal planar surfaces arranged at right angles to each other. One planar surface comprises a side wall of a carton, while two adjacent planar surfaces comprise the front and rear walls of the container. By applying pressure to the front and rear walls at a designated portion thereon, such walls are distorted along with a corresponding portion of the side wall to a position fixed relative to the conventional position of the planar surfaces. Once the paperboard has been distorted into such position, it will remain in such position because of the particular interrelationship of the arcuate fold lines to each other and the respective portion of the carton. After dispensing, the outlet may be resealed by applying slight pressure to the V-shaped pour spout portion of the container, thereby causing the fiberboard to "pop" back into its conventional side panel configuration.

From the above description, it is evident that the use of the carton of this invention comprises the steps of first separating tab 22 from end wall 10 along perforated score lines 24, 24' and 24'', then separating perforated score lines 36' and 52' by bending tab 27 upwardly, along with flap extensions 38' and 54' to provide an opening for egress of flowable particles, as depicted in FIG. 2. Thereafter, pressure is exerted on the front and rear panels of the box to distort the side wall to form a V-shaped chute as depicted in FIG. 3, and the container is tilted to promote flow of contents out through the pour spout. To enhance spout formation, fold line 20 can be slit for a portion of its upper end such as at 20'.

After use, pressure applied to the apex of the V-shaped spout causes the deformed panel portions to pop back into the conventional plane of the respective panels, thereby reclosing the box. Following the initial opening of the container, the tab member can be forced into its recess defined by perforated score lines 24, 24' and 24'', in end wall 10 to produce a substantial closure during periods of non-use during storage.

The materials of construction contemplated by the present invention may comprise any sheet material which may be shaped into the structure shown in the drawings, and which has sufficient natural resilience to enable portions of the box to be bent along crease lines and to return to the original shape when a corresponding force is applied to the V-shaped spout. Fiberboard is preferred, but this is not to be interpreted as limiting the invention.

What is claimed is:

1. A container for holding a mass of a flowable material comprising back and front walls, at least one end wall and top end flaps hingedly attached at one end of said walls, each said back and front wall being contiguous with said end wall through respective of generally upright side margins, a break-away tab formed in part by a tear line in said end wall, said tab further being formed by the hinged attachment of said end wall to a first top end flap; a pair of top end flaps hingedly attached to said back and front walls, and overlapping said first top end flap, each of said pair of top end flaps being joined to respective of said back and front walls in part by a tear hinge extending therebetween for a distance corresponding to the depth of the said first top end flap, said back and front wall top end flaps being further provided with a fold line transverse to said tear hinge; a first pair of arcuate fold lines provided in respective of said back and front walls, each of said pair of arcuate fold lines having one end thereof intersecting with the upright side margin between said end wall and respective of said back and front walls, and the other end thereof intersecting the transverse fold line at the respective top end flap, said end wall having a second pair of fold lines extending upwardly from respective side margins and being convergent relative to each other intermediate said side margins at a location near said break-away tab, each said back, front and end wall being formed of a material having sufficient flexibility to permit the back and front walls to be moved toward each other while simultaneously allowing the end wall to flex outwardly along said fold lines, whereby when said carton is filled with flowable materials, the particles can be dispensed from said carton by first separating said tab along the tear line in said end wall and said tear hinges in said pair of top end flaps, then by bending said tab upwardly about said transverse fold line, and thereafter depressing the portions of said back and front walls defined by said pair of arcuate fold lines and said end wall, so as to temporarily lock into a pour spout configuration to control the pouring of said flowable material from said container.

2. A container in accordance with claim 1 and further provided with a fold line extending along about the center of said end wall, one end of said fold line intersecting said tab, the other end of said fold line intersecting the convergence of said second pair of fold lines.

3. A container in accordance with claim 1 wherein said second pair of fold lines are arcuate.

4. A container as set forth in claim 3 and further provided with a single arcuate fold line extending between the side margin of said side walls at the intersections of said second pair of arcuate fold lines with said side margins.

5. A container as set forth in claim 4 wherein each arcuate fold line is formed on an equivalent radius of curvature.

6. A carton blank having a plurality of serially connected walls and a corresponding plurality of flaps hingedly attached at each end of said walls, a break-away tab formed in part by a tear line in a first end wall, said tab further being formed by the hinged attachment of said first end wall to a first top end flap; a pair of top flaps hingedly attached to front and back walls adjacent said first end wall, and adapted to overlie said first flap upon assembly, each of said pair of flaps being joined to respective of said adjacent walls in part by a tear hinge extending therebetween for a distance corresponding to the depth of the said first flap, said adjacent walls being further provided with a fold line transverse to said tear hinge; a further fold line extending along about the center of said first end wall, one end of said further fold line intersecting said tab; the other end of said further fold line intersecting a first pair of arcuate fold lines; said first pair of arcuate fold lines extending downwardly and outwardly in said first wall to opposite edges thereof; a second pair of arcuate fold lines provided in respective of said adjacent walls, each of said second pair of arcuate fold lines having one end thereof intersecting with the outer, downwardly formed end of respective of said first pair of arcuate fold lines at the junction between said first and said adjacent wall, and the other end thereof intersecting the transverse fold line at the respective flap, whereby when said blank is assembled to form a carton, and filled with free-flowing particles, the particles can be dispensed from said carton by separating said tab along the tear line in said first wall, said tear hinges in said pair of flaps and by bending upwardly about said transverse fold line, and depressing the portions of said adjacent walls defined by said second pair of arcuate fold lines, so as to temporarily lock in the form of a pour spout.

7. The carton blank of claim 1 further characterized by an arcuate fold line in said first wall extending between the outer, downwardly formed ends of respective of said first pair of arcuate fold lines.

8. The carton blank of claim 1 wherein each arcuate fold line is formed on an equivalent radius of curvature.

9. A container for holding a mass of flowable material comprising back and front walls, at least one end wall and top end flaps hingedly attached at one end of said walls, each said back and front wall being contiguous with said end wall through respective of generally upright side margins, a first pair of arcuate fold lines provided in respective of said back and front walls, each of said pair of arcuate fold lines having one end thereof intersecting with the upright side margin between said end wall and respective of said back and front walls, and the other end thereof intersecting the respective top end flap, said end wall having a second pair of fold lines extending upwardly from respective side margins and being convergent relative to each other intermediate said side margins, each said back, front and end wall being formed of a material having sufficient flexibility to permit the back and front walls to be moved toward each other while simultaneously allowing the end wall to flex outwardly along said fold lines, whereby when said carton is filled with flowable material, the particles can be dispensed from said carton by depressing the portions of said back and front walls defined by said pair of arcuate fold lines and said end wall, so as to temporarily lock into a pour spout configuration to control the pouring of said flowable material from said container.

* * * * *